United States Patent [19]

Varga

[11] Patent Number: 4,580,318

[45] Date of Patent: Apr. 8, 1986

[54] CARDING ENGINES

[76] Inventor: John M. J. Varga, Royd Lodge, 2, Lawrence Road, Skircoat Green, Halifax, West Yorkshire, England, HX3 0LH

[21] Appl. No.: 673,886

[22] Filed: Nov. 21, 1984

[30] Foreign Application Priority Data

Nov. 23, 1983 [GB] United Kingdom ..... 8331236

[51] Int. Cl.[4] ..... D01G 15/08

[52] U.S. Cl. ..... 19/102; 19/103; 19/111

[58] Field of Search ..... 19/102, 103, 104, 110, 19/111, 112, 113, 114

[56] References Cited

U.S. PATENT DOCUMENTS 464,161 12/1891 Lord et al. ..... 19/102

3,995,351 12/1976 Otani ..... 19/102

4,276,677 7/1981 Piske ..... 19/102

*Primary Examiner*—Louis K. Rimrodt

*Assistant Examiner*—J. L. Olds

*Attorney, Agent, or Firm*—Henry Sternberg; Bert J. Lewen

[57] ABSTRACT

A carding engine comprises a carding cylinder (1) rotatable between bends (2*a*) at each side of the carding engine. A series of flats (20) are provided, each flat having opposite end sections, the flats being movable over an arc of the cylinder surface. Each bend comprises a stationary section (2*a*) and a plurality of rollers (9, 13, 14) each mounted on the stationary section for rotation about axes parallel to the cylinder axis. The rollers are located such that the radially outermost parts thereof relative to the cylinder form a support path substantially co-axial with the cylinder, the rollers forming a support for the end sections of the flats as they travel over the arc of the cylinder surface.

10 Claims, 10 Drawing Figures

1
2a
13
21
3
12
2
3a
16
17
15
22
11
18
20
23
9
19
14

12
9
8
6
4
7
5
10

12
11
6
4
5

12
24
25
26
20
30
29
28
27

CARDING ENGINES

This invention relates to carding engines.

The most commonly used form of carding engine comprises a carding cylinder rotatable between bends at each side of the carding engine, and a series of flats, the flats being movable over an arc of the cylinder surface. The outer surface of the cylinder, and the surfaces of the flats facing towards that cylinder surface are provided with carding elements, usually in the form of wire between which fibres fed to the carding engine are carded.

It is recognised as being desirable that the movable flats be spaced as closely as possible to the cylinder and also that the spacing between the tips of the teeth on the cylinder and the tips of the teeth on each flat is as uniform as possible. Considerable problems must be overcome to achieve close, uniform settings. One major problem arises from wear between the ends of the flats and the surfaces of the bends on which those ends are supported and on which the flats slide. Wear in this region rapidly affects previously chosen settings, and the present invention seeks to reduce this problem.

According to the invention a carding engine comprises a carding cylinder rotatable between bends at each side of the carding engine, a series of flats, each flat having opposite end sections and means for moving the flats over an arc of the cylinder surface, in which each bend comprises a stationary section and a plurality of rollers each mounted on the stationary section for rotation about an axis parallel to the cylinder axis, the rollers being located such that the radially outermost parts thereof relative to the cylinder form a support path substantially coaxial with the cylinder, the rollers forming a support for the end sections of the flats as they travel over the arc of the cylinder surface.

It will be seen that as the flats travel over the cylinder the end sections of the flats are supported by the rollers, and accordingly rolling friction rather than sliding friction is involved and there is little or no wear of the end sections of the flats. Thus, by accurately setting the end sections of the flats relative to the support path reliable and consistent flat settings relative to the cylinder are achieved.

The invention is applicable to carding engines having either flexible bends or segmental bends. In the former case the stationary section of each bend is a flexible element substantially co-extensive with the arc of the cylinder over which the flats travel, the flexible bend being secured to a support after adjustment so that the support path is substantially co-axial with the carding cylinder. In the latter case the bend is divided into a number of arcuate segments, each secured to a support, the segments having been individually adjusted so that the support path is substantially co-axial with the cylinder.

It will be understood that the support path is defined by the curve obtained by drawing common tangents between the radially outermost parts of the rollers. The degree to which this support path corresponds with the arc of a circle co-axial with the cylinder depends on the diameter of the rollers and the spacing between their axes, and roller dimension and spacing is chosen so as to make this correlation as close as reasonably possible. If desired, additional small guide pieces may be interposed between adjacent rollers, the radially outermost parts of the guide pieces relative to the cylinder then also forming part of the support path.

In a first embodiment of the invention an endless belt passes along the support path supported by the rollers, and the end sections of the flats engage the radially outer surface of the belt. The belt should desirably be of flexible but relatively stiff material in order to give proper support to the end sections of the flats, and it is also important that the belt be of constant thickness to ensure substantially uniform spacing between the flats and the cylinder surface over the whole arc of travel. One single belt may span rollers around the whole arc of the bend at each side of the carding engine, or alternatively groups of rollers around the bend may each have their associated individual belt. In the case of a segmental bend each bend segment may have its associated rollers and belt. There may be circumferential overlap between the rollers and belts of adjacent bends in order to ensure that a continuous support is provided.

In a second embodiment of the invention no belt is provided and the end sections of the flats are of sufficient circumferential extent so as to span at least two adjacent rollers, or a roller and an adjacent guide piece, at all times in order to ensure that the flat is continuously supported. If necessary, each bend may support two sets of rollers, one set being axially spaced from the other, the alternate flats then having end pieces that engage alternate sets of rollers.

Any suitable means may be provided on the ends of the flats for adjusting the flats relative to the support surface, and for example either grub screws or other adjusting elements, or shims may be used for this purpose.

In order that the invention may be better understood, specific embodiments thereof will now be described in more detail, by way of example only, with reference to the accompanying drawings in which.

Figure 1:
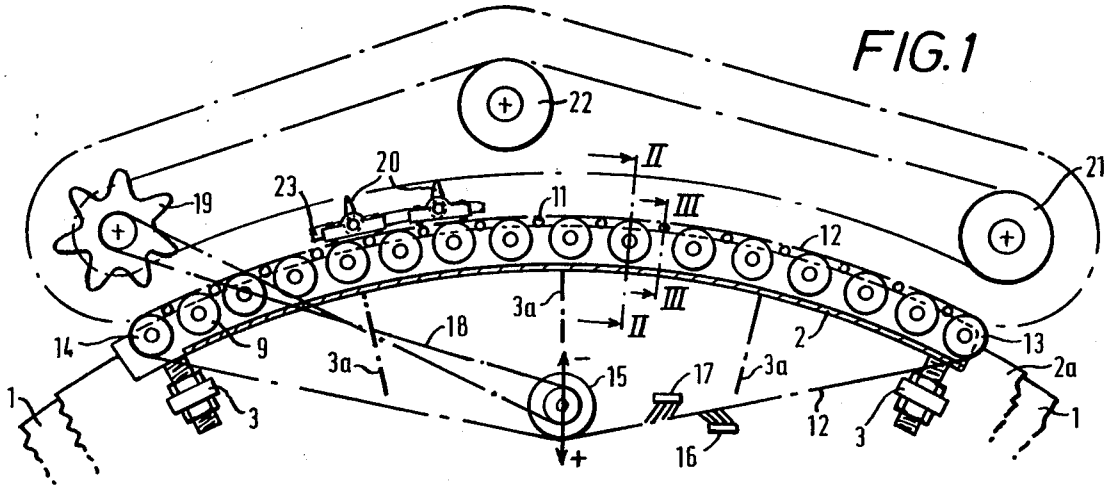
FIG. 1 is a schematic side elevation of part of a first embodiment of carding engine.

Referring now to FIG. 1 this shows part of a carding engine having a carding cylinder 1 rotatable between bends at each side of the machine. A flexible bend structure 2 is secured to the bend 2*a* and can be circumferentially adjusted relative thereto by filbows 3 at each of five equi-angularly spaced locations around the bend. This is conventional practice and only two of the filbows are illustrated in the drawing, the positions of the other three being indicated at 3*a*. In cross-section the flexible bend comprises a base member 4 and inner and outer walls 5 and 6 together forming a channel section. A series of shafts 7 extend between the walls 5 and 6 at equi-angular spacings, each shaft supporting a needle bearing 8. A roller 9 is rotatable on each needle bearing, the roller having a groove 10 formed around its circumference. Between each pair of adjacent rollers a pin 11 projects inwardly from the face 6 of the flexible bend.

A belt 12 of uniform thickness and of a resilient, flexible material engages within the groove 10 of each roller at that part of the roller that lies radially outermost with respect to the cylinder. The inner surface of the belt 12 also engages each of the pins 11 between adjacent rollers. From each of the two endmost rollers 13, 14 the belt extends to and passes around a roller 15 rotatably mounted on the fixed part of the bend. Brushes 16 and 17 are mounted on the bend 2*a* to clean respectively the two surfaces of the belt. The roller 15 is driven by a belt 18 and pulley drive from a nug wheel 19.

In conventional manner, the nug wheel drives a plurality of flats 20 along a path that takes them over an arc of the cylinder and then along a return track around two spaced block wheels 21 and 22. The flats are joined together by a chain 23, it being understood that the flat end associated chain assembly is identical at each side of the carding engine, and also that the flexible bend, roller and belt assembly is the same at each side of the carding assembly.

Figure 4:
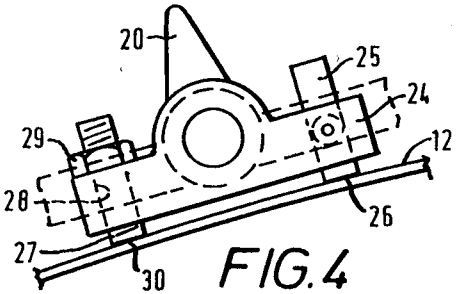
FIG. 4 is an enlarged view of part of FIG. 1.

Each end of each flat is provided with means whereby the body of the flat may be radially adjusted with respect to the surface of the support belt 12. In the example shown in FIG. 4 the heel of the bend 24 of the flat has secured thereto a bearer 25, one end 26 of which engages the outer surface of the belt 12 and is supported thereby. At the toe end of the flat a bearer 27 is provided in the form of a grub screw passing through a tapped bore 28 in the flat end and lockable in any required position of adjustment by a lock nut 29. The radially inner end 30 of the grub screw again bears on the outer surface of the belt 12. It will readily be seen that by adjustment of the grub screw the toe setting of the flat relative to the carding cylinder can be adjusted as required.

In operation the nug wheel 19 drives the flats 20 through their arcuate path over the cylinder as the cylinder rotates. Simultaneously, the nug wheel drives the roller 15. The combined effect of the rotation of this roller and the frictional drag between the support elements 25 and 27 of each flat and the outer surface of the belt cause the belt to travel with the flat, the movement being permitted by the rollers 9. The belt path along its outer arc, as defined by its engagement with the rollers and the pins 11, is substantially co-axial with the carding cylinder, and accordingly the flats travel over an arc that is also substantially co-axial and at settings relative to the cylinder that are maintained consistent according to the setting relative to the belt.

Surprisingly, the fact that the path of the belt is not exactly a true arc makes virtually no difference to the consistency of flat spacings from the cylinder over the whole of their path of travel of the cylinder. Any deviation that may occur is more than compensated for by the advantage obtained from providing rolling rather than sliding support for the flats.

Figure 2:
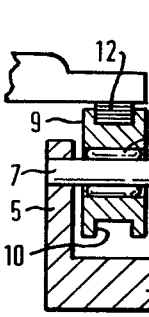
FIGS. 2 and 3 are sections on the lines II—II and III—III of FIG. 1.
Figure 3:
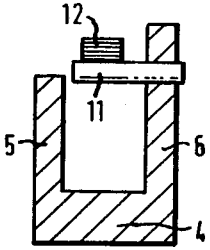
Figure 5:
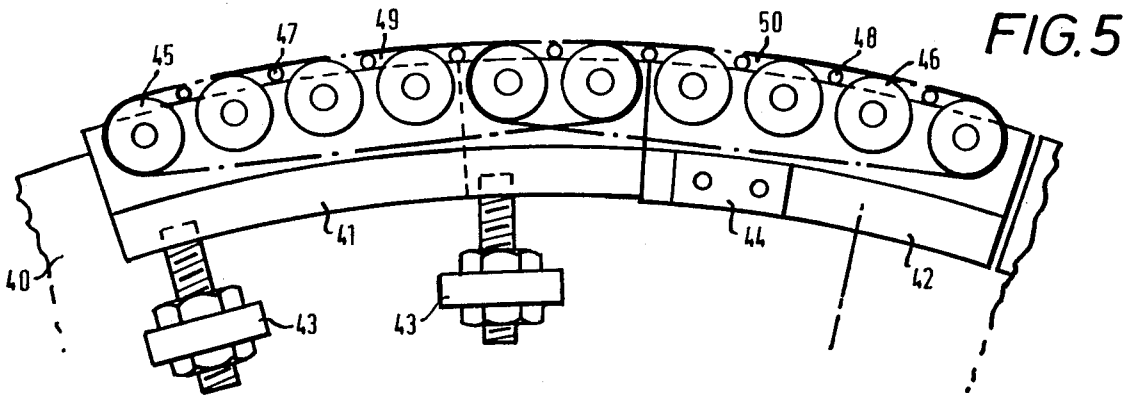
FIG. 5 is a schematic side elevation of part of a second embodiment of carding engine.
Figure 6:
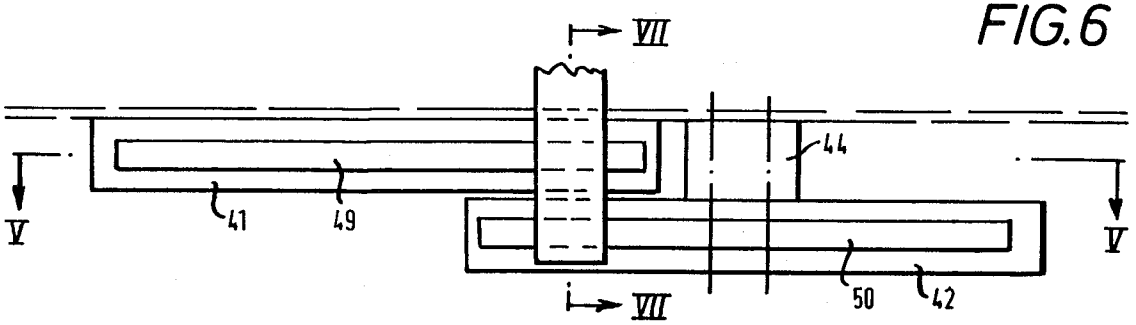
FIG. 6 is a partial plan view corresponding to FIG. 5.

Referring now to FIG. 5 this shows schematically the bend support 40 at one side of a carding engine and shows two only of a plurality of segmental bends such as 41 and 42. Each bend can be adjusted relative to the support by filbows 43 or other suitable means, the filbows for bend 41 only being shown. Alternate flexible bends are axially staggered along the bend support, thus bend 41 may be directly secured to the bend support, while bend 42 will be secured thereto by way of a suitable bridging piece or pieces 44. Each of the segmental bends is of the same general cross-sectional form as the flexible bend shown in FIGS. 1 and 2 and each supports in corresponding manner six rollers such as rollers 45 on bend 41 and rollers 46 on bend 42. Pins 47, 48 respectively may again be located between adjacent rollers. Obviously any number of rollers required according to the arcuate extent of the segment may be used. A belt 49 extends around the rollers and pins 45, 47 of the segment 41. A belt 50 similarly extends around the rollers and pins 46, 48 of bend 42, and a similar arrangement is provided for each other bend in the series. The bends are axially staggered in order that adjacent ends thereof may overlap as shown in FIG. 6.

Figure 7:
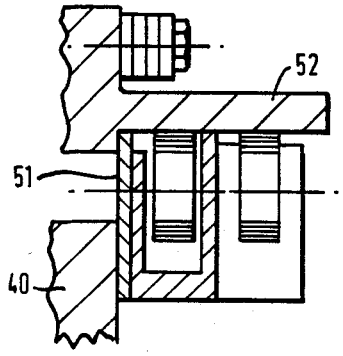
FIG. 7 is a section on the line VII—VII of FIG. 6.

A series of flats are driven around an arc of the carding cylinder by a chain, nug wheel and block wheel arrangement that may be similar to that shown in FIG. 1. The flats are laterally guided at each side of the carding engine by a guide plate such as 51 secured to the bend support 40. The end section 52 of each flat is of such axial width that it is able to engage belts 49 and 50 simultaneously in the overlap region of the flexible bends, and so that at any time it will be supported by the belt of an appropriate one of the bends. As the flats travel around their arc the frictional engagement between the flat ends and the belts causes the belts to move on the rollers, and there is no need in this embodiment for the belts to be otherwise driven. The flat end 52 is shown in direct contact with the belts 49 and 50 in FIG. 7, but it will be understood that an appropriate adjusting means between the flat end and the belts may be included.

Figure 8:
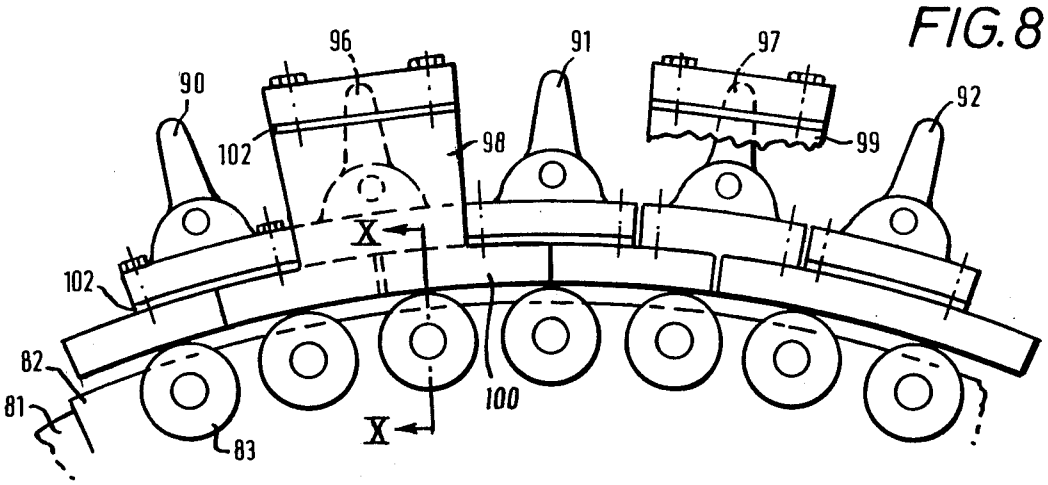
FIG. 8 is a schematic side elevation of part of a third embodiment of carding engine.

FIG. 8 shows at 81 part of the bend support of a third embodiment. A flexible bend 82 is mounted on the support and adjustable relative thereto by filbows in similar manner to that shown in FIG. 1.

Figure 10:
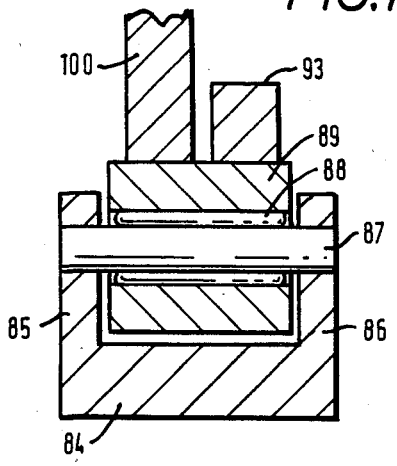
FIG. 10 is a section on the line X—X of FIG. 8.
Figure 9:
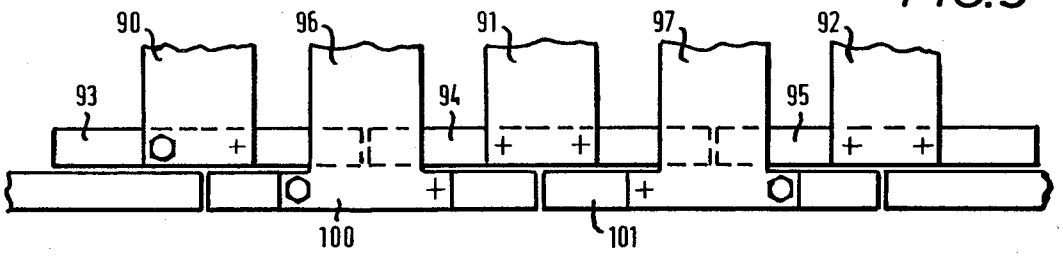
FIG. 9 is a partial plan view corresponding to FIG. 8.

FIG. 10 shows a cross-section through the flexible bend, which comprises a base 84 and side walls 85, 86 between which extends a series of shafts 87, each supporting by way of a needle bearing 88 a roller 89, the axial width of which is greater than the roller of FIG. 1. No belt is provided in this embodiment and it is purely and simply the roller surfaces that form the support surfaces for the ends of the flats. Accordingly, it is necessary that the ends of the flats are of sufficient arcuate extent as always to be in engagement with two or more adjacent rollers. This in turn makes it preferred that adjacent flats have axially staggered end sections, as shown in FIG. 9.

Flats 90 to 92 have end pieces 93 to 95 respectively that run on the axially inner regions of the rollers 89. Flats 96 and 97 are fitted with bridging sections 98, 99 at their ends, the bridging sections supporting end pieces 100, 101 which are supported on the axially outer regions of the rollers. It will thus be seen that at all times each flat is supported by two adjacent rollers; furthermore, the end piece arrangement is such that the flats can travel around the block wheels and nug wheels without one flat interfering with the adjacent flats.

In order to set the flats relative to the support surface formed by the envelope of the rollers in this embodiment it is preferred that the body of the flat be settable relative to its end section either by shims such as 102 between the flat body and the end section, or by any other suitable adjusting means at this location. Indeed, it will be understood that the adjustment means described in any of the particular embodiments may be designed as required to suit the particular carding engine.

It will similarly be realised that other modifications can be made to the particular embodiments illustrated in the drawings.

I claim:

1. A carding engine comprising a carding cylinder rotatable between bends at each side of the carding engine, a series of flats, each flat having opposite end sections and means for moving the flats over an arc of the cylinder surface, in which each bend comprises a stationary section and a plurality of rollers each mounted on the stationary section for rotation about axes parallel to the cylinder axis, the rollers being located such that the radially outermost parts thereof relative to the cylinder form a support path substantially co-axial with the cylinder, the rollers forming a support for the end sections of the flats as they travel over the arc of the cylinder surface.

2. A carding engine according to claim 1 in which an endless belt passes along the support path supported by the rollers and the end sections of the flats engage the radially outer surface of the belt.

3. A carding engine according to claim 1 in which a guide piece is interposed between adjacent rollers with the radially outermost parts of the guide pieces relative to the cylinder also forming part of the support path and supporting the belt.

4. A carding engine according to claim 2 in which the belt is of flexible, resilient material of substantially uniform thickness throughout its length.

5. A carding engine according to any one of claims 2 to 4 in which a single belt spans all rollers at one side of the carding engine.

6. A carding engine according to claim 2 in which a first belt spans a first group of rollers at one side of the carding engine, and a further belt spans a further group of rollers at the same side of the carding engine.

7. A carding engine according to claim 6 in which the first and further belts are axially spaced and circumferentially overlap.

8. A carding engine according to claim 1 in which the end sections of the flats are of sufficient circumferential extent to span at least two adjacent rollers.

9. A carding engine according to claim 8 in which a guide piece is interposed between adjacent rollers with the radially outermost parts of the guide pieces relative to the cylinder also forming part of the support path, and the end sections of the flats are of sufficient circumferential extent to span at least one roller and an adjacent guide piece.

10. A carding engine according to claim 8 in which each bend supports two sets of rollers, one set being axially offset from the other, and alternate flats have end pieces supported from one set of rollers, the remaining flats having end pieces supported from the other set of rollers.

* * * * *